US007550063B2

(12) United States Patent
Gawad

(10) Patent No.: US 7,550,063 B2
(45) Date of Patent: Jun. 23, 2009

(54) METHOD AND APPARATUS FOR CRACKING HYDROCARBONS

(75) Inventor: Karol Pawel Gawad, Katowice (PL)

(73) Assignee: Altene (Canada) Inc. (CA)

( * ) Notice: Subject to any disclaimer, the term of this patent is extended or adjusted under 35 U.S.C. 154(b) by 424 days.

(21) Appl. No.: 11/213,381

(22) Filed: Aug. 26, 2005

(65) Prior Publication Data

US 2007/0045098 A1 Mar. 1, 2007

(51) Int. Cl.
*C10B 1/00* (2006.01)

(52) U.S. Cl. ..... 202/241; 202/117; 202/239; 422/204; 422/210; 196/112

(58) Field of Classification Search ..... None
See application file for complete search history.

(56) References Cited

U.S. PATENT DOCUMENTS

| | | | | | |
|---|---|---|---|---|---|
| 148,806 | A | | 3/1874 | Brundred | 196/119 |
| 1,183,457 | A | | 5/1916 | Herber | 208/7 |
| 1,231,695 | A | | 7/1917 | Bell | 196/122 |
| 1,418,414 | A | | 6/1922 | Wells et al. | 208/72 |
| 1,541,140 | A | | 6/1925 | Heller | 208/48 R |
| 1,622,573 | A | | 3/1927 | Cross | 196/122 |
| 1,677,758 | A | | 7/1928 | Frank | 208/7 |
| 4,127,473 | A | | 11/1978 | Hozuma et al. | 208/130 |
| 4,432,941 | A | * | 2/1984 | Spencer | 422/140 |
| 4,443,328 | A | | 4/1984 | Sakurai et al. | 208/106 |
| 4,512,873 | A | | 4/1985 | Escher et al. | 208/13 |
| 5,356,530 | A | | 10/1994 | Calderon | 208/108 |
| 5,716,205 | A | * | 2/1998 | Tratz | 432/103 |
| 5,821,396 | A | * | 10/1998 | Bouziane | 585/241 |
| 5,885,444 | A | | 3/1999 | Wansbrough et al. | 208/179 |
| 6,005,149 | A | | 12/1999 | Bishop | 585/241 |
| 6,485,631 | B1 | * | 11/2002 | Ellingsen | 208/142 |

FOREIGN PATENT DOCUMENTS

| | | | |
|---|---|---|---|
| CA | 1227970 | | 10/1987 |
| DE | 41 07 294 | | 9/1992 |
| EP | 0 667 799 | | 7/1997 |
| EP | 1 077 248 | * | 2/2001 |
| EP | 1 067 171 | | 4/2004 |
| GB | 244275 | | 12/1925 |
| GB | 457960 | | 12/1936 |
| GB | 2094336 | * | 9/1982 |
| WO | WO 01/58582 | | 8/2001 |
| WO | WO 02/26915 | | 4/2002 |

OTHER PUBLICATIONS

International Search Report, Oct. 26, 2006, 5 pages.
Written Opinion of the International Searching Authority, Nov. 3, 2006, 5 pages.

* cited by examiner

*Primary Examiner*—N. Bhat
(74) *Attorney, Agent, or Firm*—St. Onge Steward Johnston & Reens LLC

(57) ABSTRACT

The invention relates to both a method and apparatus for thermal cracking hydrocarbons. The apparatus includes a rotating conical drum assembly within a vessel containing a hydrocarbon feedstock. The conical drum assembly is internally heated to cause cracking of hydrocarbons adjacent the conical drum surface and the formation of coke on its external surface as the conical drum rotates. Coke is removed from the drum surface by a coke removal system and cracked hydrocarbon product is collected as a vapor.

15 Claims, 16 Drawing Sheets

(A)

(E)

SHEET 1/2

(B)

(C)

(D)

SHEET 2/2

METHOD AND APPARATUS FOR CRACKING HYDROCARBONS

FIELD OF THE INVENTION

The invention relates to both a method and apparatus for thermal cracking hydrocarbons. The apparatus includes a rotating conical drum assembly within a vessel containing a hydrocarbon feedstock. The conical drum assembly is internally heated to cause cracking of hydrocarbons adjacent the conical drum surface and the formation of coke on its external surface as the conical drum rotates. Coke is removed from the drum surface by a coke removal system and cracked hydrocarbon product is collected as a vapor.

BACKGROUND OF THE INVENTION

As is known hydrocracking is a process by which large/heavy hydrocarbons are broken down into smaller and more useful hydrocarbons including paraffins and olefins. There are generally two methods of cracking namely thermal cracking, in which the heavy hydrocarbons are subjected to high temperatures; and catalytic cracking, in which a catalyst is introduced into a reaction mixture to enable cracking to occur at lower temperatures.

While the cracking of hydrocarbons is known, it is desirable to provide improved thermal cracking processes in which the formation of lighter olefins and paraffins can be effectively controlled in an efficient and continuous process. More specifically, it is desirable to provide a process in which the smaller hydrocarbons are efficiently produced at reaction temperatures between the cracking temperature and the carbonization temperature of a heavy hydrocarbon mixture while also continuously removing coke and sulphur from the reaction mixture.

A review of the prior art reveals that such a system has not been previously described. For example, U.S. Pat. No. 6,005,149 describes a method and apparatus for processing organic materials to produce chemical gases and carbon char; U.S. Pat. No. 5,356,530 describes a method for upgrading petroleum residuum and heavy crude oil; U.S. Pat. No. 1,677,758 describes the treatment of carbonaceous and other materials; U.S. Pat. No. 1,622,573 describes a coking still; U.S. Pat. No. 1,541,140 describes a process and apparatus for distilling and cracking hydrocarbon oils; U.S. Pat. No. 1,183,457 describes an oil distillation process; U.S. Pat. No. 1,231,695 describes an apparatus for refining petroleum; U.S. Pat. No. 1,418,414 describes a process of making unsaturated hydrocarbon material; U.S. Pat. No. 148,806 describes oil-stills; PCT/EP 01/11016 describes a process and apparatus for the fractional distillation of crude oil; EP 1 067 171 describes a process for removing contaminants from oil; EP 0 667 799 describes a method for selective and/or unselective vaporization and/or decomposition of, particularly, hydrocarbon compounds and an apparatus for carrying out such a method; PCT/RU 00/00097 describes a method and device for resonance excitation of fluids and method and device for fractionating hydrocarbon liquids; and DE 41 07 294 describes a cracking system.

SUMMARY OF THE INVENTION

In accordance with the invention, there is provided a system for cracking hydrocarbons comprising: a vessel for operatively receiving and containing a volume of liquid hydrocarbon feedstock; a rotary drum assembly operably and rotatably contained with the vessel and in heating contact with the hydrocarbon feedstock, the rotary drum assembly including a heating system for heating the internal surfaces of the drum assembly during rotation of the drum assembly within the hydrocarbon feedstock wherein simultaneous rotation and heating of the drum assembly causes cracking of hydrocarbons; a vapor product collection system operatively connected to the vessel for receiving cracked hydrocarbon vapors; and a coke removal system operatively contained within the drum for removing coke from the drum assembly and vessel.

In one embodiment, the drum assembly includes two frustoconical end sections and a central cylindrical section operatively mounted between front and back pipe sections.

In another embodiment, the drum assembly and vessel includes a bearing system and the bearing system includes a cooling system for cooling the bearings during operation. In a preferred embodiment, the bearing cooling system includes a spiral oil path within each of the front and back pipe sections and the bearing system.

In one embodiment, the burner includes a secondary air injection system for injecting secondary air into an inside position of a conical flame.

In yet another embodiment, the vapor product collection system includes a quenching system for quenching vapor product to prevent coking within the vapor product collection system.

In yet still another embodiment, the coke removal system includes a plurality of scrapers in operative contact with the exterior surface of the drum assembly, the coke removal system including at least one coke pit for allowing coke to be removed from the drum.

In another aspect of the invention, a process for cracking hydrocarbons is provided, comprising the steps of: heating a rotating surface to a given temperature; exposing the rotating surface to a volume of oil to be cracked thereby causing the volatization of light hydrocarbons and the formation of a thixotrophic suspension of cracked heavy oil and coke on the rotating surface; collecting evaporated cracked heavy oil; and scraping and removing coke from the rotating surface. Preferably, the rotation speed and rotating surface temperature are balanced to produce dry coke before coke is scraped from the rotating surface.

In further embodiments, the rotating surface is operatively contained within a vessel and the volume of oil to be cracked is maintained at a fixed height relative to the rotating surface and the rotation speed of the rotating surface is controlled to produce a thin-film thixotropic mixture of olefins and paraffins on the rotating surface for a given temperature.

BRIEF DESCRIPTION OF THE DRAWINGS

The invention is described with reference to the drawings in which.

DETAILED DESCRIPTION OF THE DRAWINGS

Figure 1:
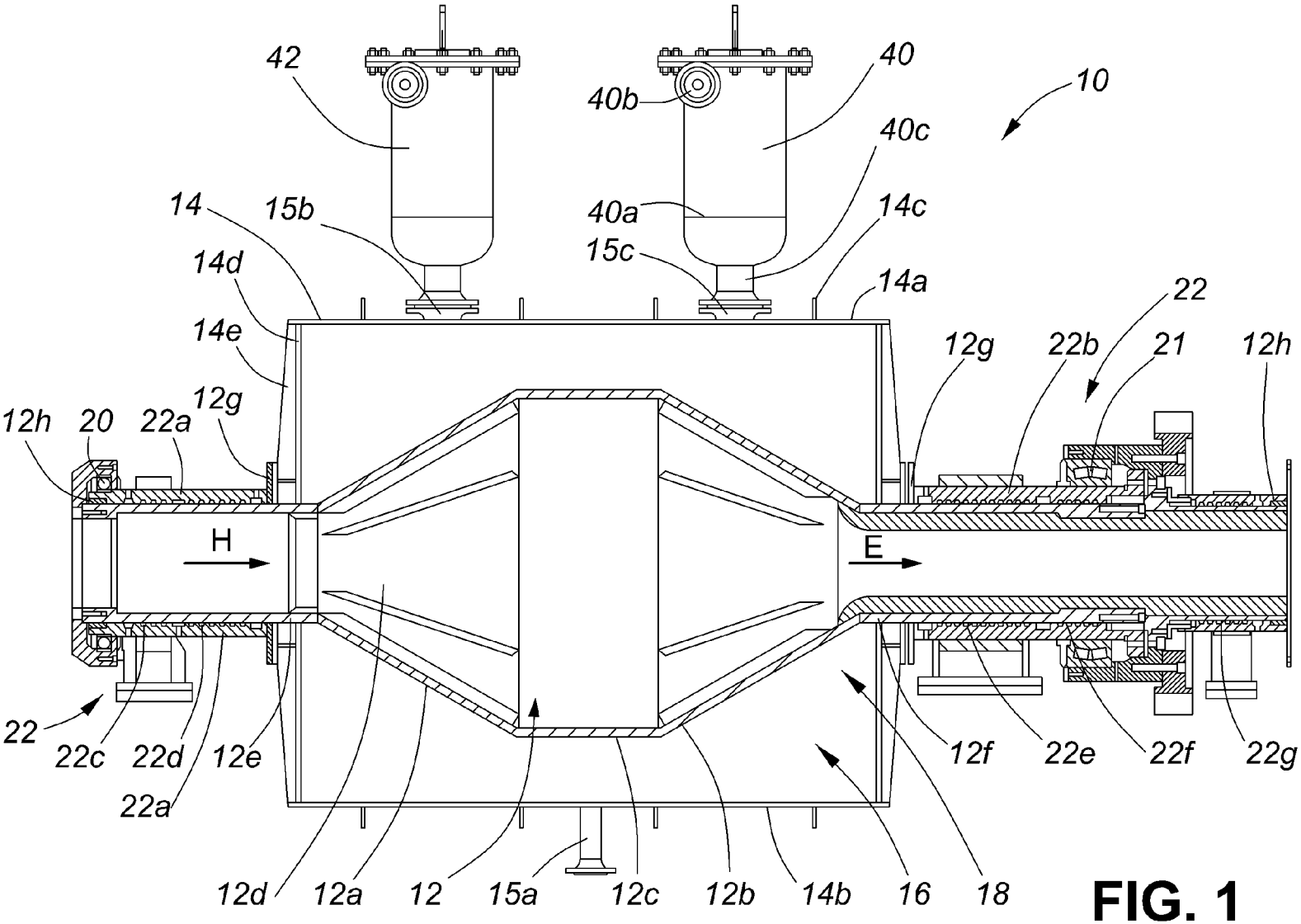
FIG. 1 is a cross sectional view of a rotary disc thermal cracker (RDTC) in accordance with one embodiment of the invention.

In accordance with the invention and with reference to the figures, a process and apparatus for cracking hydrocarbons using a rotating heated surface is described.

Overview of Apparatus and Process

More specifically, the process includes, as described in relation to one rotation cycle, the steps of heating a rotating surface to a given temperature; exposing the rotating surface to a volume of oil to be cracked thereby causing the volatization of light hydrocarbons and the formation of a thixotrophic suspension of cracked heavy oil and solid coke on the rotating surface; collecting evaporated cracked product; continuing to heat the suspension until coking occurs; and, scraping and collecting coke from the rotating surface.

Furthermore, in accordance with the invention, the preferred apparatus to carry out the process is a rotary disc thermal cracker (RDTC) 10 as shown in FIGS. 1-9. The RDTC includes a drum assembly 12 preferably comprised of two conical surfaces 12*a*, 12*b* and a central cylindrical surface 12*c*. The drum assembly 12 is hollow thus defining a fire chamber 12*d* allowing heated air and flame from a burner to heat the inner surface of the drum assembly. The drum assembly 12 is rotatably mounted within an external cylindrical vessel 14 thereby defining an external liquid space 16 for containing a volume of feedstock heavy oil having a liquid level 18 within the external vessel casing 14.

More specifically, in operation, as the drum assembly 12 rotates within the external vessel 14, a portion of the outer surface of the drum assembly 12 is always partly submerged within the feedstock oil. As the outer surface of the drum assembly 12 rotates in the feedstock oil, the hot surface will rapidly heat the oil, resulting in flash evaporation of light hydrocarbons and cracking of the heavy hydrocarbons as the drum assembly rotates. A high temperature gradient is created within the oil in proximity to the drum assembly, which causes the formation of a thixotropic suspension of solid coke and cracked products that adhere to the outside of the cylinder and cone surfaces.

As the coated surface of the drum assembly 12 rotates out of the oil, adhered hydrocarbons continue to be heated, evaporating the cracked products and forming dry coke against the heated surface. Scrapers 30*a* (FIGS. 4, 5A, 5B) mounted within the vessel 14 scrape the baked coke from the surfaces of the cylinder assembly into coke pits 32. The surface of the drum assembly is thereby cleaned prior to it being re-submerged within the feedstock oil of the drum.

The RDTC also includes two vapor quenchers 40, 42 (FIG. 7) designed to collect vaporized hydrocarbons and to cool the heavier fractions to below their cracking point temperature wherein the heavier hydrocarbons condense and fall back into the external vessel 14 of the RDTC for re-cracking.

Rotating Drum Assembly 12

With reference to FIGS. 1, 2A, 2B, 3B and 5A, the rotating drum assembly 12 and fire chamber 12*d* is preferably assembled from two frustoconical sections welded to opposite ends of a short central cylindrical section and two pipe shafts (front shaft 12*e* and back shaft 12*f*) welded to the narrow ends of the frustoconical sections. Bearings 20 mounted to the pipe shafts support the drum assembly within a bearing support and cooling system 22 that enables the drum assembly 14 to rotate around its horizontal axis and maintain the bearing temperature within design limits.

The rotating drum assembly is designed to contain the heat of a burner operably connected to the input end H of the drum assembly 12. Preferably, the burner flame produces a flame temperature in the range of 3000° F. within the drum assembly and fills the internal volume 12*d* of the assembly thereby providing an exterior surface temperature of the rotating drum in the range of 1200° F. The resulting flue gas will have a temperature in the range of 1500° F. that leaves the fired chamber through back shaft 12*f* at the exhaust end E. The exhaust end E is preferably connected to a heat recovery furnace (FIG. 11) located downstream.

As noted above, the design temperature of the exterior of the drum assembly is in the range of 1300° F. As the torque forces and material stresses are highest in the area of pipe section welding to the cone, materials such as 18Cr-8Ni—Ti type steels (ASTM A312 TP-321H) having creep limit of 4.5 $kG/mm^2$ @ 1292° F. are preferably utilized in the construction of the drum assembly 12.

As described in greater detail below, the external surfaces and bearing systems of the front and back shafts 12*e*, 12*f* are preferably cooled by a bearings cooling system 22 including vacuum oil in a spiral labyrinth system. The front shaft 12*e* and back shaft 12*f* are protected against cooling oil leakage by spring rings 12*g* at the vessel side and packing gland 12*h* at the burner or exhaust side, respectively.

Figure 2A:
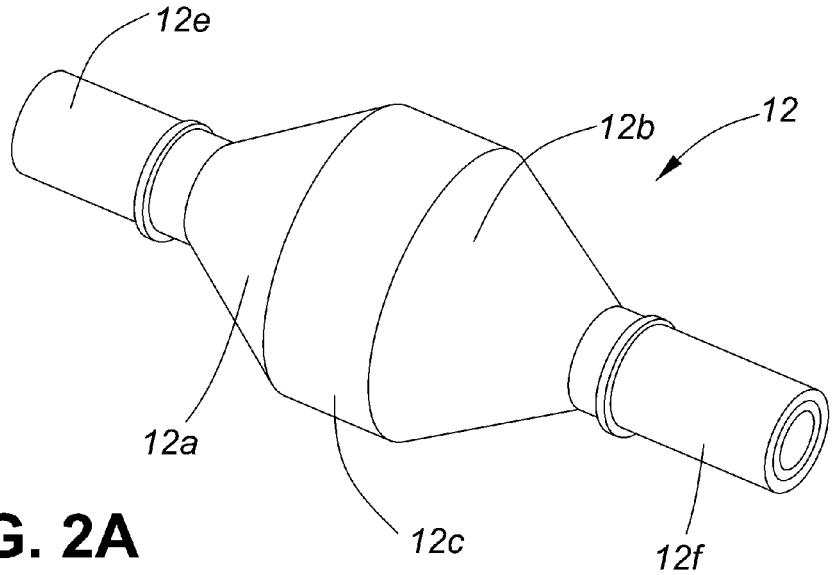
FIG. 2A is a perspective view of the rotating drum assembly in accordance with one embodiment of the invention.
Figure 2B:
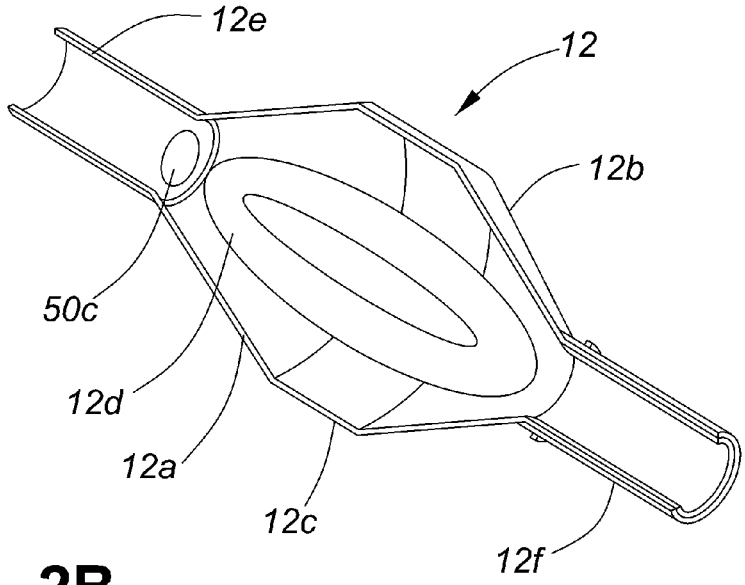
FIG. 2B is a cross-sectional perspective view of the rotating drum assembly in accordance with one embodiment of the invention.
Figure 3A:
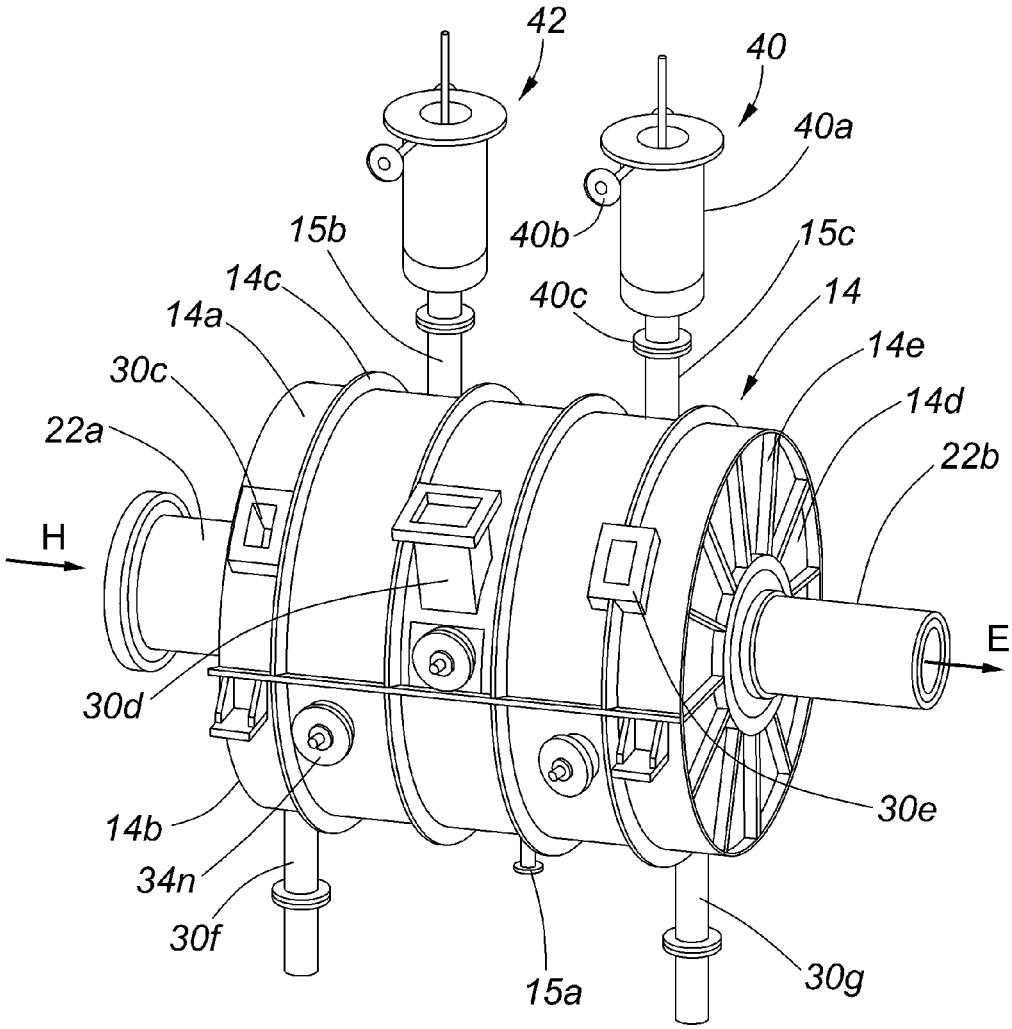
FIG. 3A is a perspective view of the external vessel assembly in accordance with one embodiment of the invention.
Figure 3B:
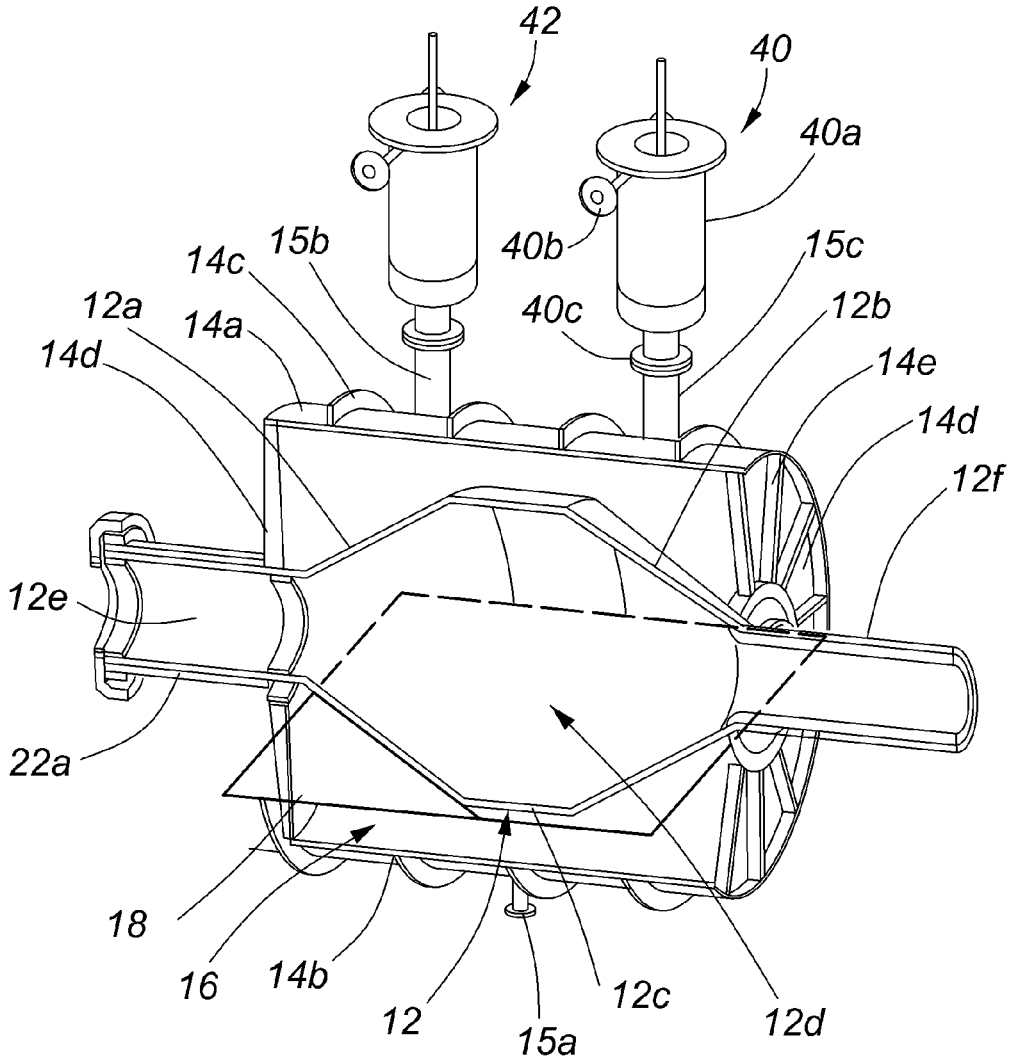
FIG. 3B is a cross-sectional perspective view of the external vessel and rotating drum assembly in accordance with one embodiment of the invention.

FIG. 2A shows a perspective view of the drum assembly and FIG. 2B shows a perspective view of the drum assembly in cross section.

Figure 8:
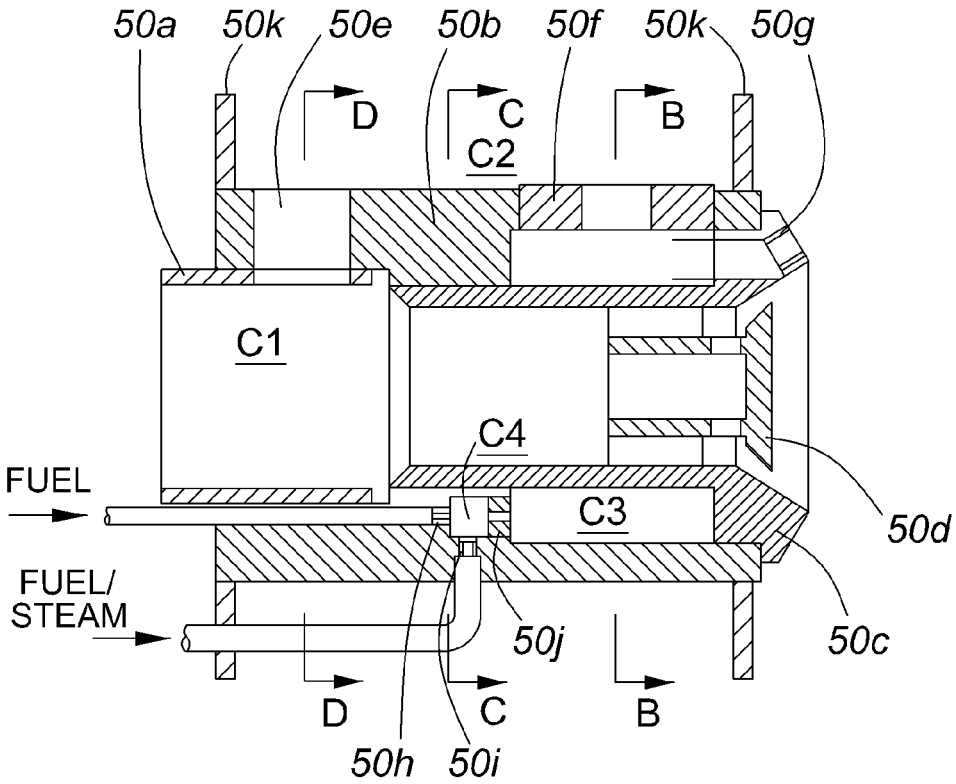
FIG. 8 are various cross-sectional views of a burner in accordance with one embodiment of the invention.
Figure 8:
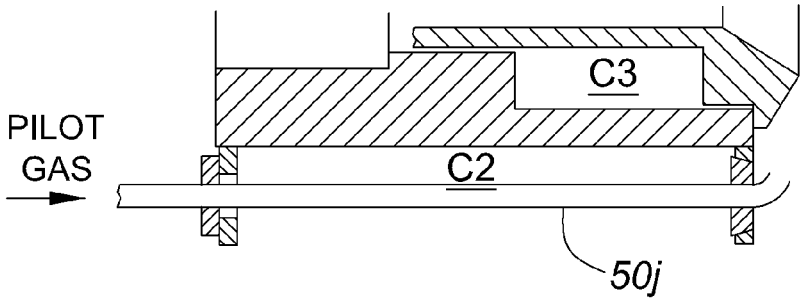
Figure 8:
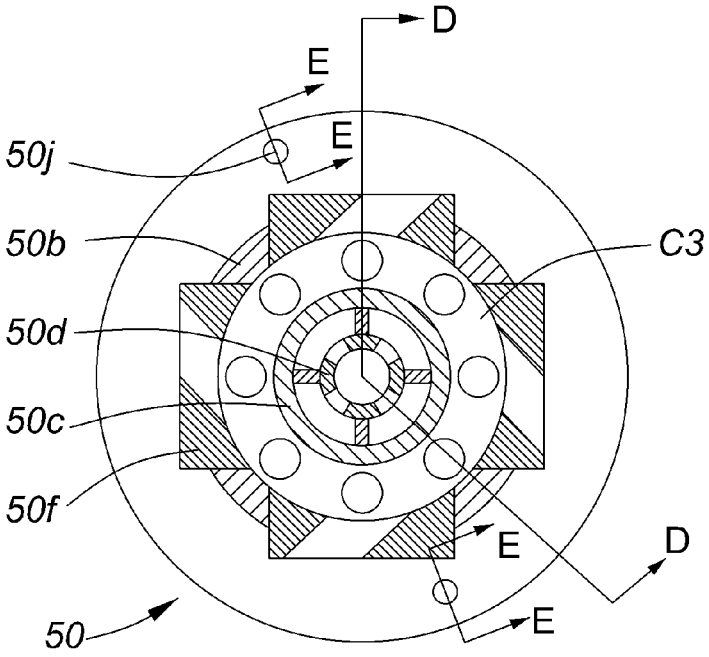
Figure 8:
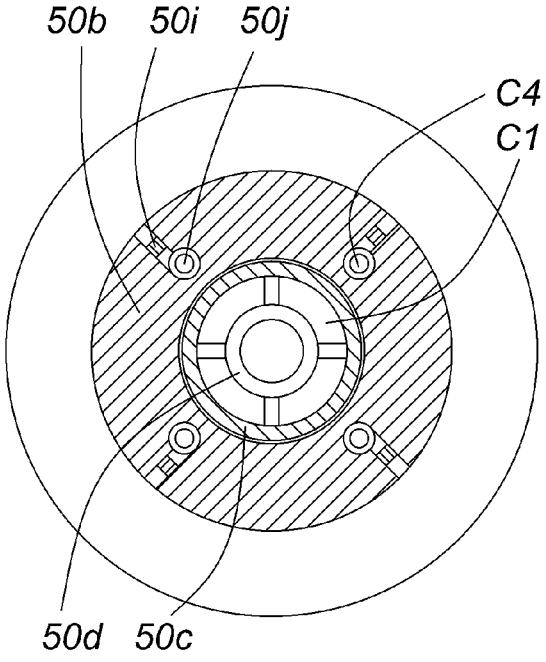
Figure 8:
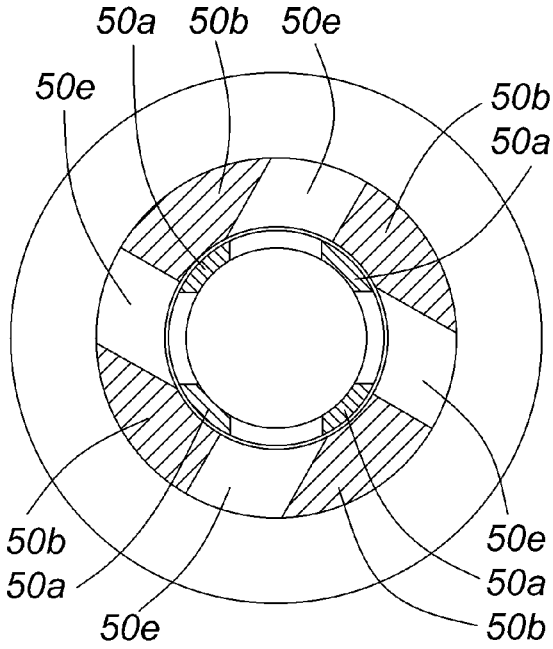

FIG. 2B also shows a preferred embodiment in which the burner (FIGS. 8 and 9) enables secondary air flow distribution within the drum assembly. Secondary air flow distribution generally operates oppositely to typical burner performance, where secondary air surrounds the flame core and allows control of the shape of the flame. Control of the shape of the flame enables the flame to effectively contact and heat the inner surface of the drum assembly. In the specific design described herein, the shape of the drum assembly requires a cigar-shaped flame where secondary air fills the fire core thereby providing effective contact of the flame with the drum assembly inner surface and that provides an equalization of the radial temperature profile across the length of the drum assembly. FIG. 8 shows details of the burner tip construction.

External Vessel 14

The external vessel 14 of the RDTC is a horizontal vessel as shown in FIGS. 1, 3A, 3B and 5A. In a preferred embodiment the vessel 14 is comprised of curved steel casing sections 14*a*, 14*b* with stiffening ribs 14*c* and plate ends 14*d* with radial stiffening ribs 14*e*. Bearing supports and bearings are operably connected to the vessel casing through external base pipes 22*a* and 22*b* of bearing system 22. The vessel 14 is preferably assembled in two sections (bottom section shown in FIG. 5A) to enable both initial assembly and disassembly of the vessel for inspection and maintenance of the internal components.

The vessel includes a feedstock inlet nozzle 15*a* located on the underside of the vessel to introduce feedstock into the system and appropriate outlets 15*b*, 15*c* for vapor products and the vapor quenching system 40, 42. The vapor product nozzles 15*b*, 15*c* are preferably located on the opposite side of the casing to the scraping system (described below) to avoid contact between baked coke and quencher return oil.

The operating temperature of the feedstock within the drum is approximately 700° F. with vapor temperatures in the range of 750° F. As the system is normally operated with high sulphur concentrations within the typical feedstock, it is preferred that the drum casing is manufactured from type SS 304 steel, ASTM A240 TP304 or equivalent.

Scraping System 30

The vessel casing 14 also operatively retains a scraping system 30 (FIGS. 4, 5A, 5B) to remove coke adhered to the drum surface and remove scraped coke from the vessel. The scraping system is maintained in contact with the rotating drum so as to cleanly remove adhered coke and channel the coke towards coke pits 32 where the coke falls by gravity from the vessel 14. The scrapers are preferably adjustable in their linear position to maintain an appropriate contact position with the rotating drum within a clearance of c.a. 1/64" during the coke removal process. The scrapers may be angled (and be adjustable by an adjustment system 34) both to ensure that coke is channeled to the coke pits 32 and to enable adjustment for any linear temperature gradient along the horizontal axis of the cylinder assembly. Each of the surfaces of the drum assembly have a separate scraper and coke collection system such that coke can be removed along the full length of the rotating drum assembly.

Figure 4:
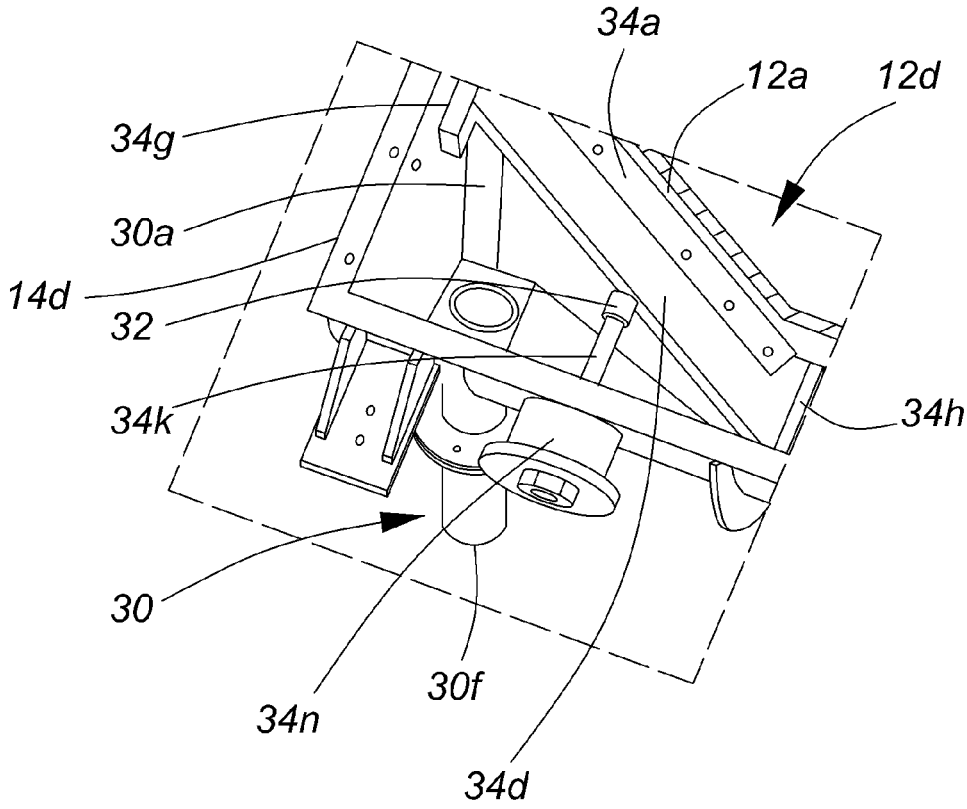
FIG. 4 is a perspective view of the scraper assembly in accordance with one embodiment of the invention.
Figure 5A:
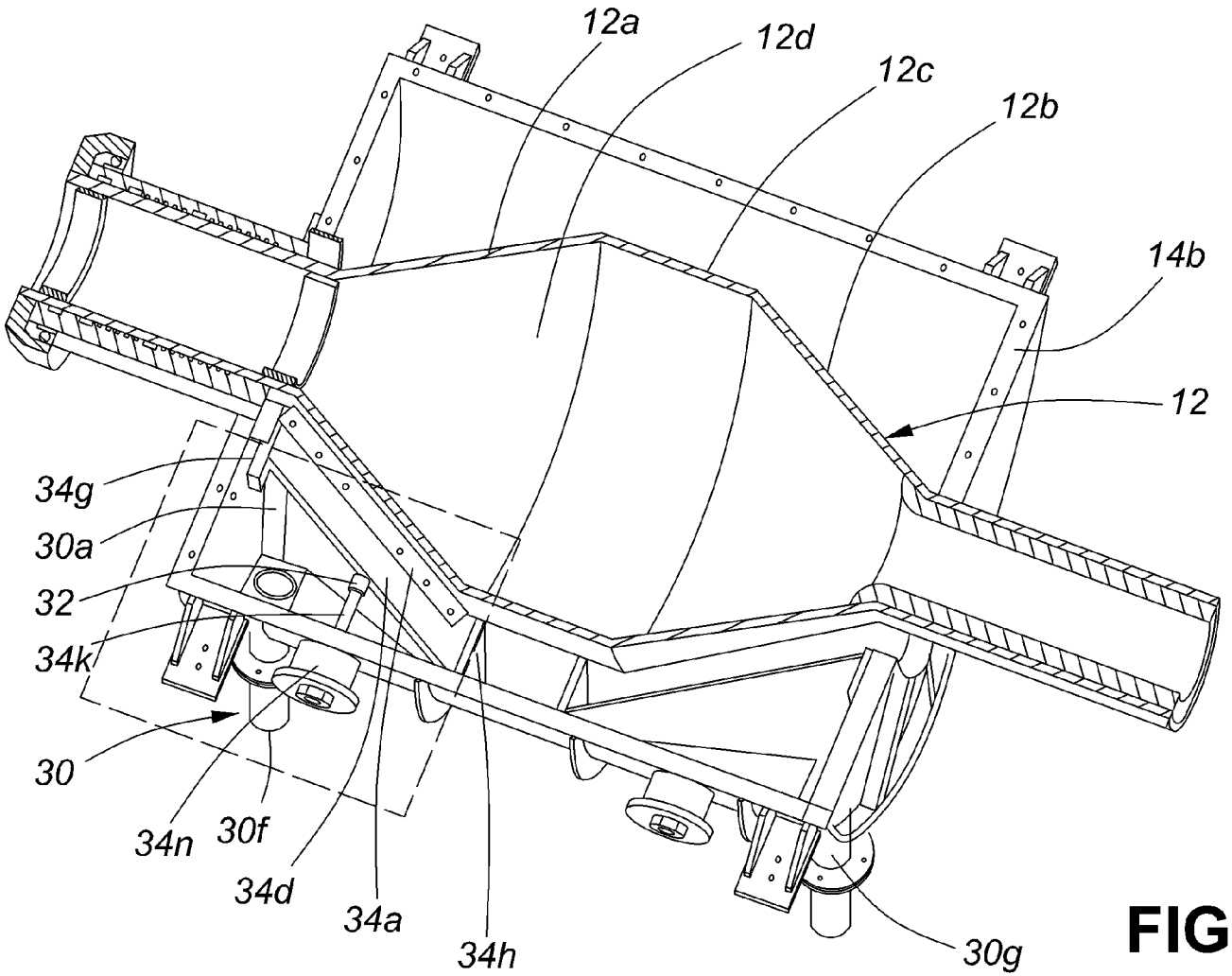
FIG. 5A is a perspective view of the external vessel, rotating drum assembly and scraper assemblies in accordance with one embodiment of the invention.
Figure 5B:
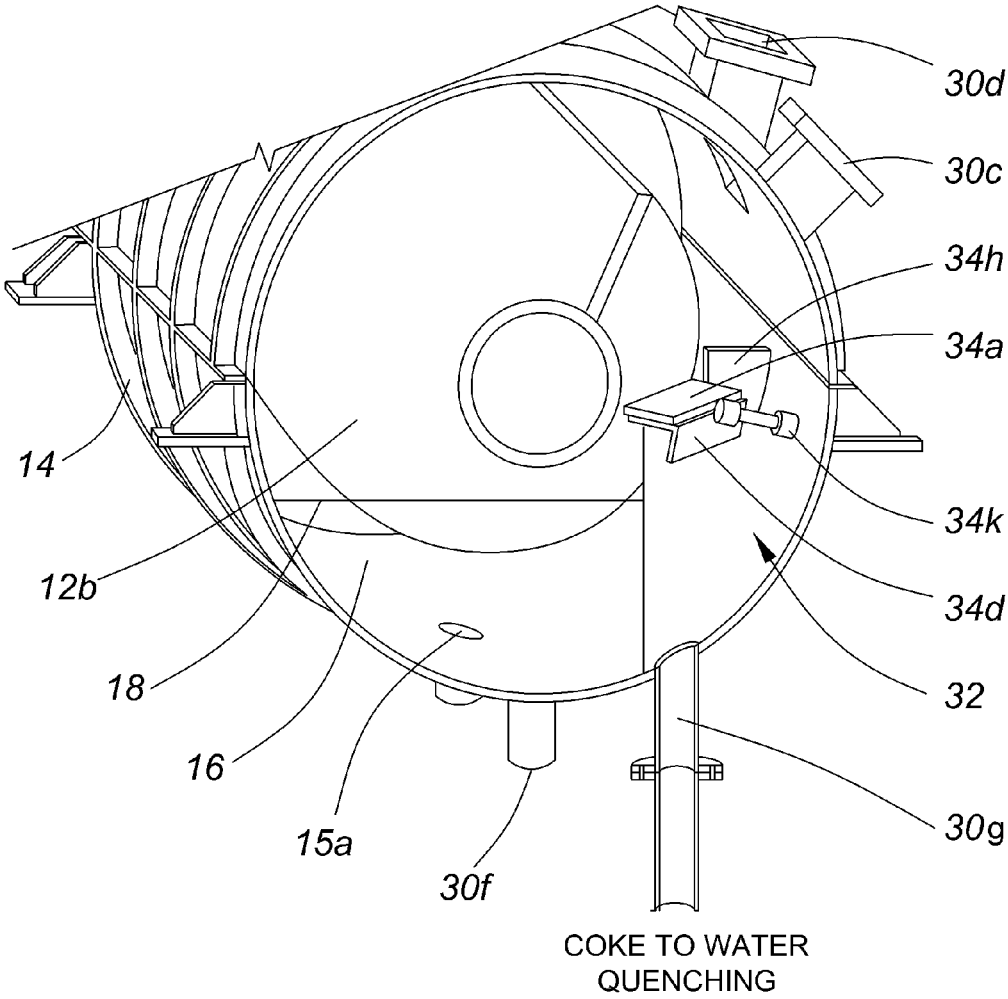
FIG. 5B is a cross-sectional perspective view of the external vessel, rotating drum assembly and scraper assemblies in accordance with one embodiment of the invention.

The adjustment system 34 includes a scraper strap 34*a* fastened on a scraper base 34*d*. Whilst FIG. 4 shows the scraping system on the left side of the RDTC only, separate scraping systems exist for each of the central and right hand side sections of the rotating drum. Each base is supported on a slide pair 34*g*, 34*h*. The position of each scraper can be adjusted by screw adjusters 34*k* passing through a gland assembly 34*n* on the exterior of the vessel 14 to enable adjustment of the scraper 34*a* from the exterior of the vessel. The vessel may also include appropriate openings 30*c*, 30*d*, 30*e* to enable an operator to visually inspect the position of each scraper. The vessel casing will preferably also include appropriate internal baffles (shown as 30*a*) to ensure that coke falls towards the coke pits.

Coke leaving the drum through chutes 30*f* and 30*g* is quenched with stagnant water as will be described below.

Bearings Cooling System 22

In a preferred embodiment, the system also includes a bearing cooling system 22 (FIGS. 1, 6A, 6B) to ensure that the bearings 20 and 21 are maintained with normal design temperatures during operation. The rotating drum 12 is supported by shafts 12*e*, 12*f* on external bearings base 22*h* and internal bearings case 22*i* at the ends of each shaft. The bearings are preferably located at the ends of the shafts to minimize the risk of the bearings jamming in the event that the bearing cooling system malfunctions. That is, by locating the bearings at the ends or towards the ends of the shafts, the bearings will be subjected to lower temperatures.

As noted above, the typical design temperature of the rotating drum connections between the frustoconical surfaces and the shafts 12*e*, 12*f* is approximately 1300° F. In addition, the design temperature of the vessel casing 14 at the connection to the external base pipes 22*a* and 22*b* is 840° F. The typical design temperature of the bearings is less than 300° F. As a result, it is necessary that both the shafts 12*e* and 12*f* and base pipes 22*a* and 22*b* be cooled down against the heat flux by metal conduction and heat radiation from the rotating drum 12 to the bearing races through the shafts.

In a preferred embodiment, the bearing cooling system includes a series of spiral channels 22*c/d* and 22*e/g* surrounding the shafts that enable the flow of cooling oil around the front and back shafts. The spiral channel is preferably a trapezoidal thread fixed on the internal surface of the supporting pipes 22*a*, 22*b*. The distance between the crest of each thread to the shaft 22*e*, 22*f* is minimized to scrape any coke forming on hot shaft surfaces caused by the partial thermal cracking of the cooling oil during operation.

Figure 6A:
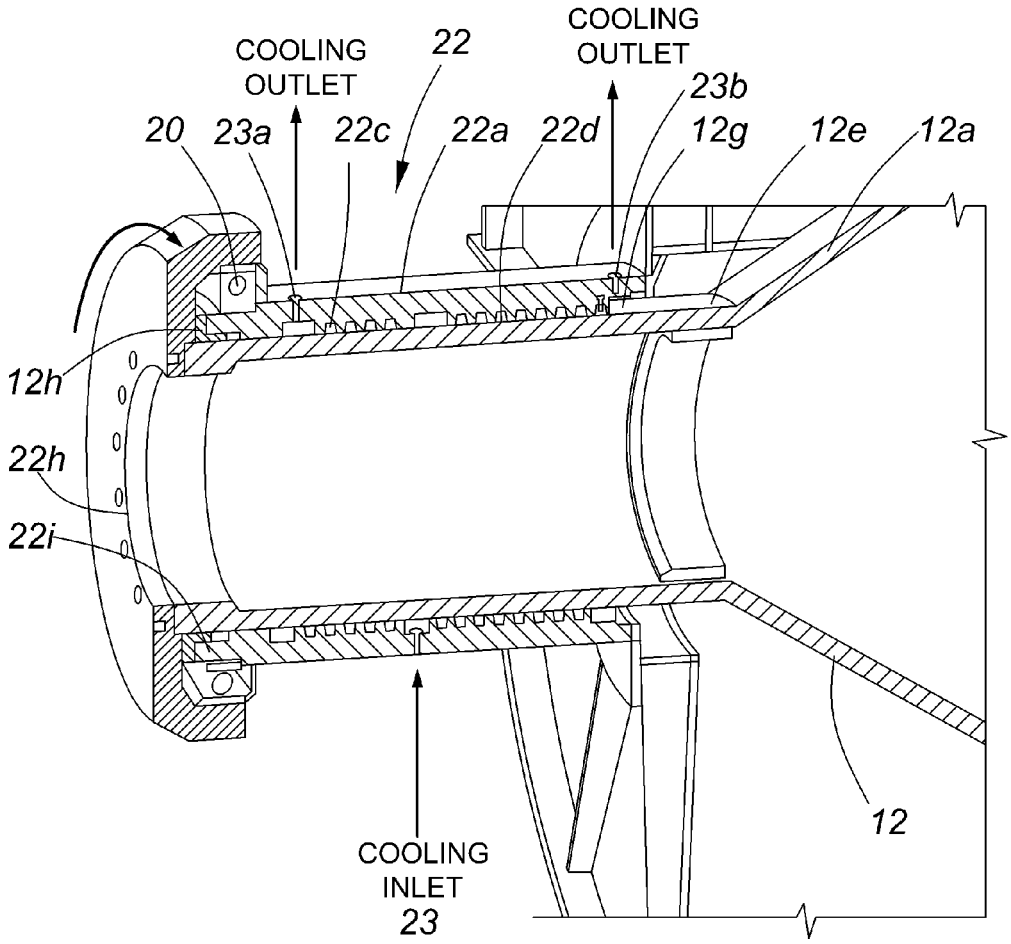
FIG. 6A is a cross-sectional perspective view of the bearing assembly on the burner side of the RDTC in accordance with one embodiment of the invention.
Figure 6B:
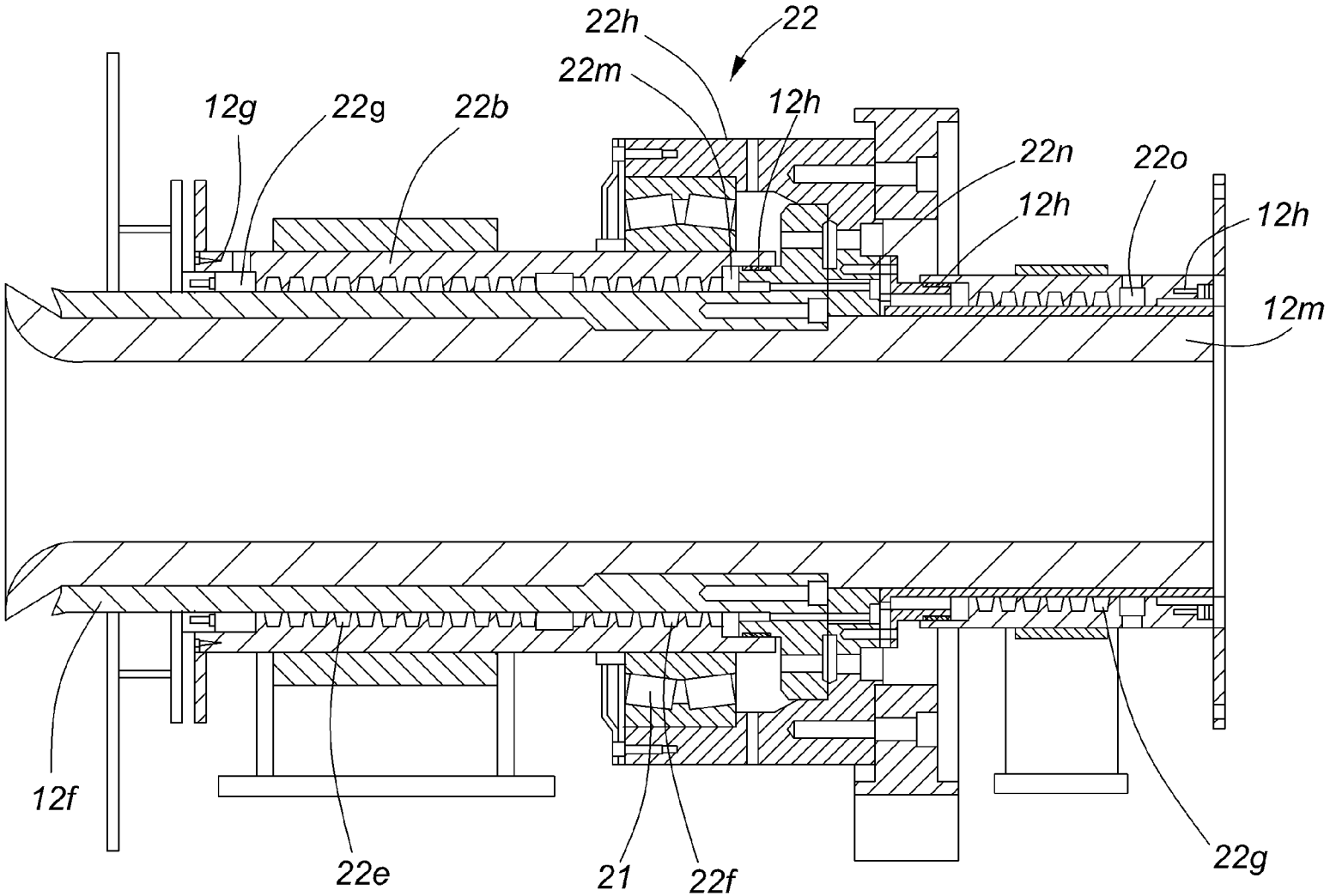
FIG. 6B is a cross-sectional view of the bearing assembly on the exhaust side of the RDTC in accordance with one embodiment of the invention.
Figure 7:
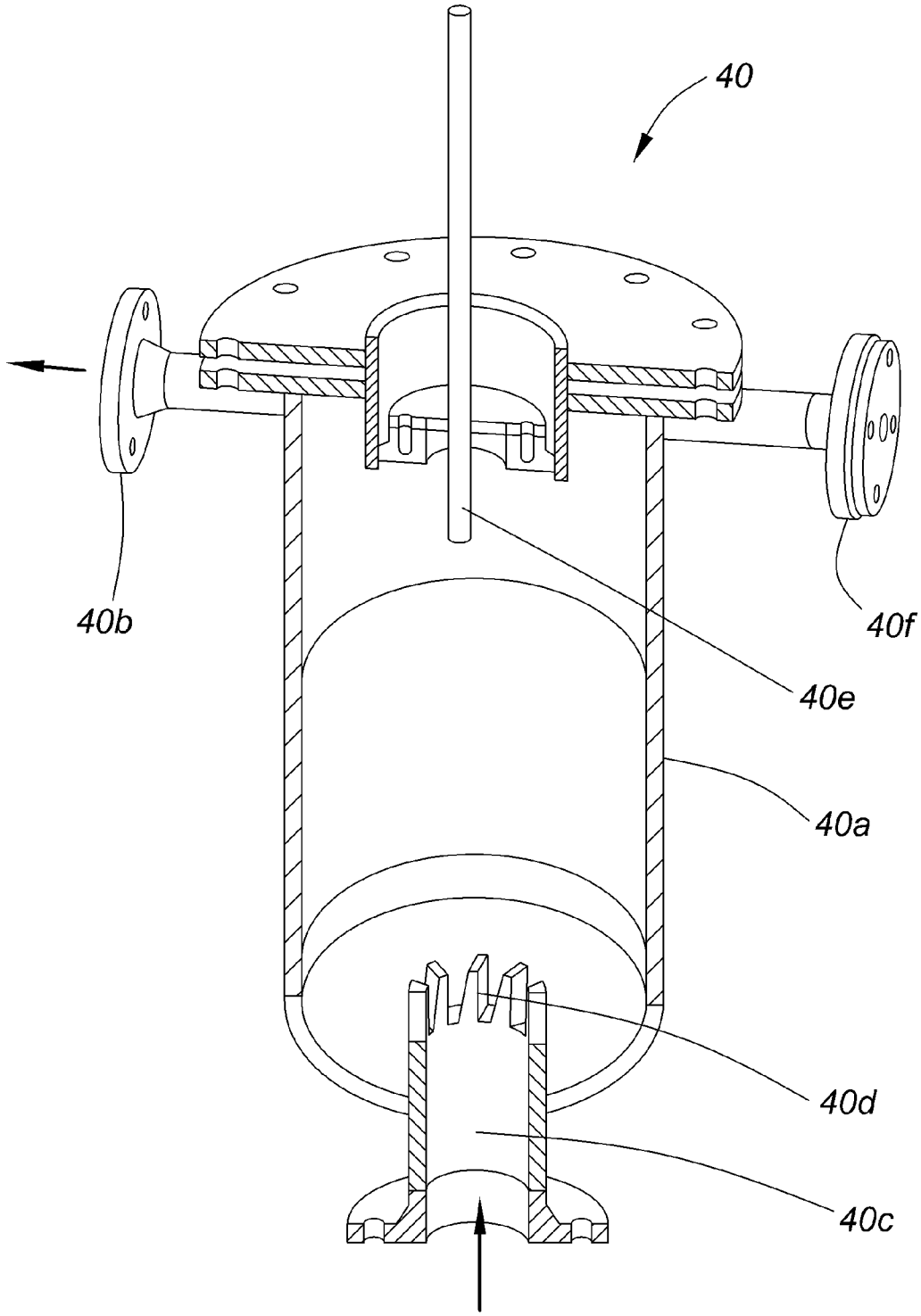
FIG. 7 is a cross-sectional perspective view of a quenching system in accordance with one embodiment of the invention.

In operation, cooling oil entering the spiral channels on the burner side is split into two streams as shown in FIG. 6A. Cooling oil enters an inlet chamber 23 located the midpoint of external supporting pipe 22*a* and is directed to both sides of the inlet into spiral channels 22*c*, 22*d*.

During passage through the spiral channels, the cooling oil may be heated to temperatures in the range of 390° F. thereby cooling both the base pipe 22*a* and shaft 12*e*. The cooling oil exits the spiral channels through nozzles 23*a*, 23*b* adjacent the spring rings 12*g* and the bearings base 22*h*, respectively.

Figure 11A:
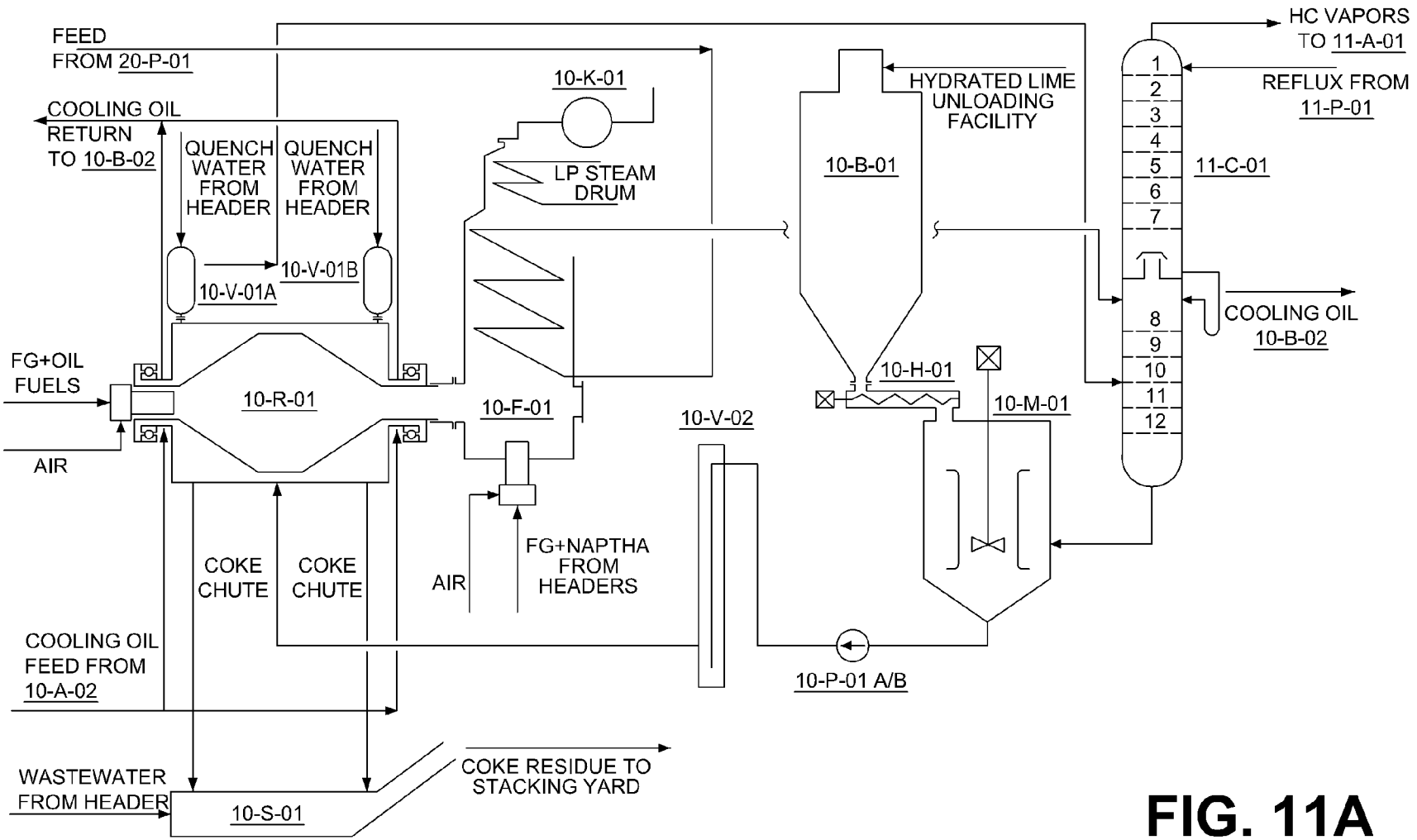
FIG. 11B is a schematic diagram showing additional detail of the plant of FIG. 11A.
Figure 11B:
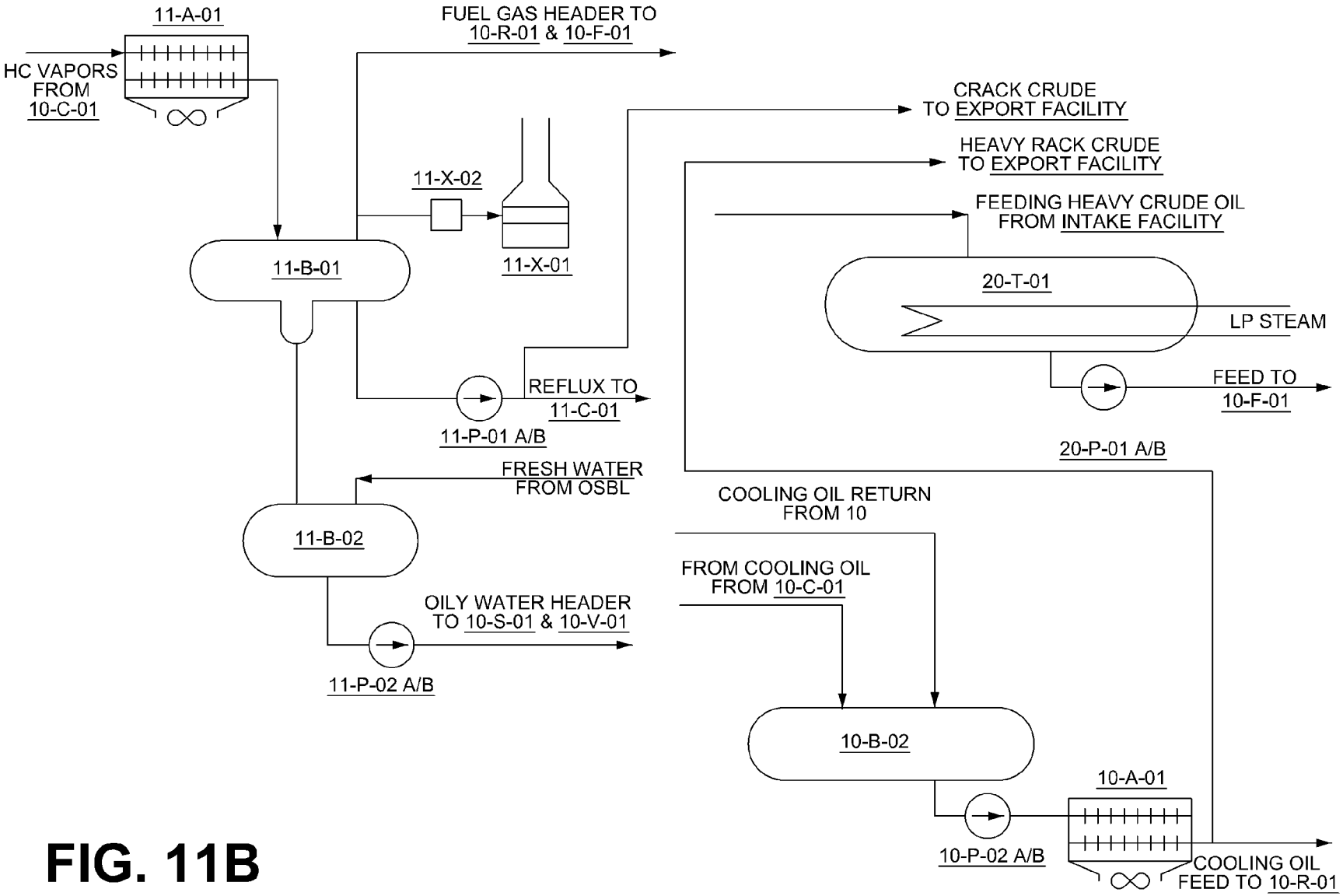

Heated cooling oil is collected within an external heat radiator system (FIG. 11).

The length of the spiral channels and nozzle diameters 23*a*, 23*b* are selected to control the pressure of the two cooling oil streams. Preferably, the back pressure of cooling oil through channel 22*d* is set to the cracker operation pressure, whereas the back pressure through channel 22*c* is set at atmospheric pressure.

The cooling system 22*b* on the exhaust side is comprised of three sections. Cooling oil enters an inlet chamber located at the midpoint of external pipe 22*b*. As with the burner side, cooling oil is directed through a first spiral channel 22*e* adjacent the vessel 14 where it will be heated to approximately 390° F. thereby cooling both base pipe 22*b* and shaft 12*f*. The cooling oil exits the spiral channel through an outlet nozzle 22*q* adjacent the spring ring 12*g*.

A second stream of cooling oil is directed through spiral channel 22*f* into an intermediate chamber 22*m* closed from the exhaust side bearing race by packing glands 12*h*. The intermediate chamber 22*m* is connected to a system of cooling channels 22*n* within the bearing support adjacent a third series of spiral grooves 22*g*. Cooling oil passes through and exits spiral grooves 22*g* through outlet channel 22*o*.

As with the burner side, the length of the spiral channels and outlet nozzle diameters are selected to control the pressure of the two cooling oil streams. Preferably, the back pressure of cooling oil through channel 22*e* and nozzle 22*q* is set to the cracker operation pressure, whereas the back pressure through channels 22*f*, 22*g* and nozzle 22*o* is set at atmospheric pressure.

In a preferred embodiment, the bearing system on the exhaust side is positioned at a greater radial distance than the bearing system on the burner side due to the higher temperatures on the exhaust side. The exhaust side also preferably includes a refractory liner 12*m* on the inside of tube 12*f*.

Quenching System 40

Hot hydrocarbon vapors leaving the cracker will typically have temperatures higher than the cracking temperature of particular hydrocarbons. As a result, and in order to avoid coke accumulation within the vapor line, the vapors are quenched by oily water injection into the quenching system 40. The quenching system includes a quenching drum 40*a*, a product vapor tangential outlet 40*b*, a hot vapor inlet 40*c*, an eccentric circular weir 40*d*, an oil/water spray nozzle 40*e* and cleaning device access 40*f*.

The injection of oily water with the resulting water evaporation is applied to decrease the temperature of HC vapor down to 600~680° F. which is a safer temperature for its further handling and to prevent coke formation. Preferably, the vapor outlet nozzles 40*b* are tangential, thereby promoting a vortex flow of vapors through the quencher which promotes mixing of quenching liquids with the HC vapors. The quenching system will also preferably include cleaning nozzles located in a diametrically opposite position to the outlet nozzle enabling the cleaning of the oil/water spray nozzles during normal cracker operation.

The decrease in vapor temperature also causes the condensation of small quantity of HC liquid that is collected on the lower surfaces of the quencher and that will spill back to the drum 14 over weir 40*d*.

The internal surface of the hot vapor inlet nozzle 40*c* is wet by HC condensates at temperatures higher the cracking temperature of the HC condensates and, as a result, can be plugged by a coke layer. To avoid coking, the internal surface is preferably protected against coking by a silicate coating that is periodically washed by a small quantity of cooling oil.

Burner Assembly 50

Figure 9:
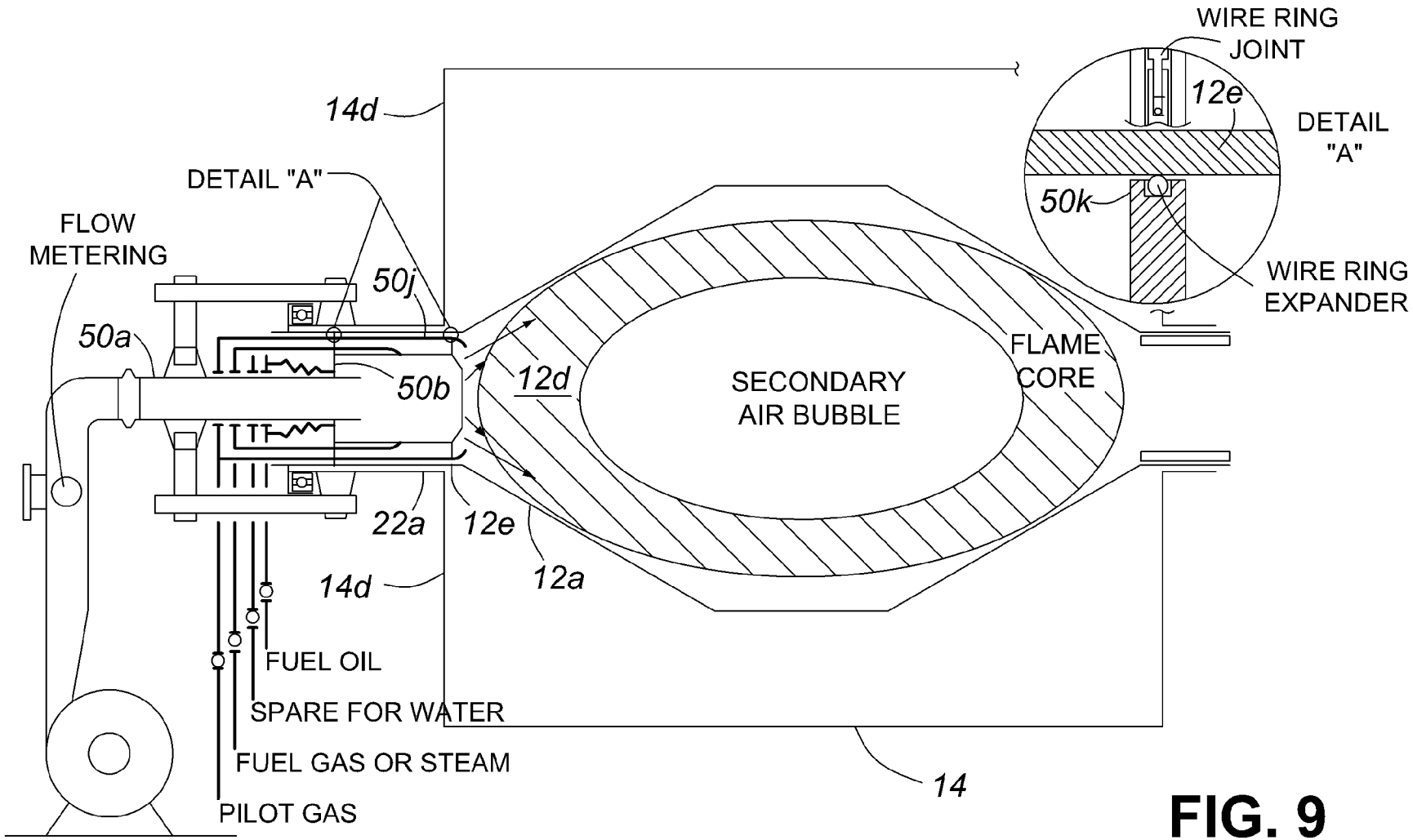
FIG. 9 is a schematic cross sectional view of a burner and rotating drum assembly and external vessel assembly in accordance with one embodiment of the invention.

With reference to FIGS. 8 and 9, the burner assembly is described. The burner is mounted to the inside of shaft 12*e*. The burner assembly 50 is fixed relative to the rotating front shaft 12*e* and includes a shaft contacting system 50*k* that isolates the burner within the shaft from the atmosphere at the inlet side of the shaft 12*e* and the vessel casing side. The burner assembly includes a fixing burner pipe 50*a*, adjustable burner base 50*b*; fixed flame distribution tip 50*c* and adjustable air distribution tip 50*d*.

Combustion air is supplied from a burner fan (FIG. 9) to burner base 50*b* and internal chamber C1 where the combustion air is split into primary and secondary air. Primary air flows through four swirlers 50*e* to vortex chamber C2, where the air is heated by contact with shaft 12*e*. Vortex space C2 is defined by contacting system 50*k*, such that heated air enters chamber C3 through four swirling nozzles 50*f*. Inside chamber C3, heated primary air is cross-contacted with fuel oil spray streams and the resulting mixture is jetted into the drum assembly 12 through angled nozzles 50*g*.

Pumped fuel oil also flows through four channels into four dispersing chambers C4 via central axial inlet nozzles 50*h*. Inside of chamber C4, the oil liquid is dispersed into droplets by contact with dispersing fuel gas or a steam vortex created by tangential nozzles 50*i*. The vortex of chamber C4 is accelerated by central axial outlet nozzles 50*h* and injected into mixing chamber C2.

The jets from nozzles 50*g*, have a lower cone angle than the drum cones 12*b* and are ignited by a small pilot flame created by an ignition and flame watch system.

A small turn of the burner base 50*b* around fixing pipe 50*a* restricts swirlers 50*e* and thus changes the ratio of primary to secondary airs. Tightening the distribution tip 50*d* throttles the circular nozzle of secondary air and decreases its flow and impact. As a result of the secondary air conical shape, the flame angle can be controlled from a long cylindrical shape to full contact of fire to with the internal surface of rotating drum 12. As a result, control of the net heat power can be controlled in the range of 25% to 100%.

Process Thermodynamics

The thermal cracking process is simplified to the following steps;

Heating to boiling point of lighter volatile compounds

Vaporization of lighter volatile compounds

Heating to crack point temperature and evaporation of cracked volatile products

Heating up to carbonization temperature

The typical crack point temperature of heavy crude oil compound is usually 600~715° F., the carbonization temperature of 95 Wt % carbon products is c.a. 1000° F.

The cracking process can be simplified to a two-step reaction:

1: Hydrocarbon chain breaks into olefin and short paraffin:

$$C_nH_{2n+2} \rightarrow C_mH_{2m} + C_pH_{2p+2} \quad n = p + m$$

2: Olefin chain breaks into paraffin and carbon:

$$C_mH_{2m} \rightarrow C_{m-1}H_{2m} + C$$

As crude oil is a complex and indefinite mixture, the value of "n" will vary from 6 up to a few hundred. As an example, n-decane cracked at the end of its chain:

$$C_{10}H_{22} = C_8H_{18} + C_2H_4 - Q_b$$

$$C_2H_4 = CH_4 + C + Q_c$$

$Q_b$=25.0 kJ/kmol @ 77° F. and 25.9 kJ/kmol @ 1031° F.

$Q_c$=35.4 kJ/kmol @ 77° F. and 35.3 kJ/kmol @ 1031° F.

n-decane cracked at the midpoint of its chain:

$$C_{10}H_{22} = C_7H_{16} + C_3H_6 - Q_b$$

$$C_3H_6 = C_2H_6 + C + Q_c$$

$Q_b$=21.4 kJ/kmol @ 77° F. and 22.8 kJ/kmol @ 1031° F.

$Q_c$=29.0 kJ/kmol @ 77° F. and 28.8 kJ/kmol @ 1031° F.

Taking the Le-Chatelier rule into consideration, the expected thermodynamic effects of oil cracking are:

Olefin formation is an endothermic reaction, thus heating of the feedstock over its crack point temperature will cause formation of olefins Olefin chain breaking is an exothermic reaction, thus oil cooling at temperatures higher than crack point will cause the formation of carbon Over-force oil heating moves the C—C bond breaking towards the endpoint, such that any increase of heat flux increases light product yield The total reaction heat of long paraffin breakage into a mixture of lighter paraffin and olefins and free carbon is exothermic. Thus, during the thermal cracking, olefin product losses by evaporation will be limited and the content of olefins in the reaction end-product will be reduced.

Operational Parameters

Figure 10:
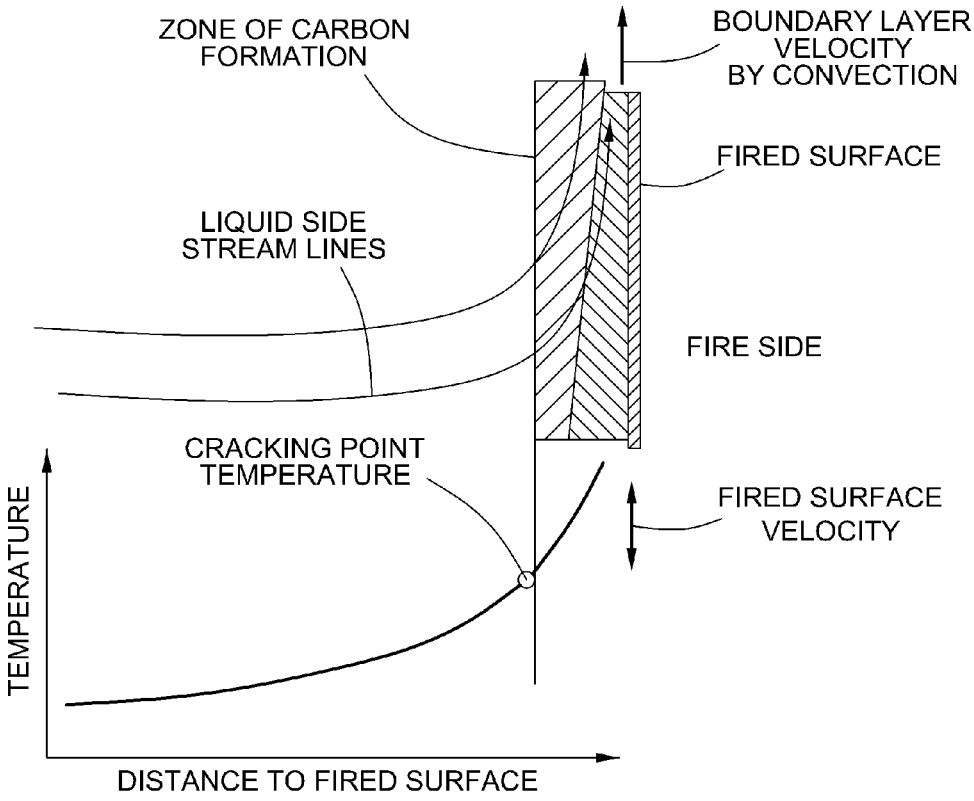
FIG. 10 is a schematic diagram of the cracking process as a function of drum temperature and distance from the drum wall; and, FIG. 11A is a schematic diagram of a plant incorporating the RDTC in accordance with one embodiment of the invention.

FIG. 10 illustrates boundary layer effects of drum temperature, drum velocity and distance to the drum in the coke and cracking reactions. Generally, as the distance from the heated surface increases, the temperature decreases and, as the velocity of the drum increases, the time for reaction decreases. The temperature of the drum surface will also affect the coke forming reactions where coke formation is increased with increasing surface temperatures. Within the liquid phase, a thin film boundary layer comprising olefins and paraffins will exist that separates the heated surface from forming coke. As the velocity of the rotating drum increases, the boundary layer will be thinner due to shear forces and the coke layer becomes thicker.

It is important that the thickness of the boundary layer is controlled to ensure that the boundary layer is sufficiently thin in order to ensure an optimum dry coke layer and to prevent contact of a thick boundary layer (comprising a thixotropic mixture of olefins and paraffins) with the scrapers.

Thus, various operational parameters of the system may be controlled to ensure desired product formation based on feedstock composition and desired products. Flame temperature and rotational speed of the rotary drum are the primary parameters adjustable to optimize the operation of the system. The liquid feedstock level within the drum is preferably controlled to maintain a consistent time relationship between wetting time and coking time at about 1:2. That is, the liquid level within the drum casing is maintained such that approximately one third of the outer circumference of the drum is wetted at any given time. Preferably the speed of rotation of the drum assembly provides a coking time in the range of 3-8 seconds for a given flame temperature.

As indicated above, the process described above provides:

- Oil heating by convection by the heated disc within the feedstock liquid
- Formation of a coke/liquid suspension adjacent the submerged disc
- Flash evaporation of light contaminants adjacent the submerged disc
- Formation of an adhered oil layer on the emerging disc
- Evaporation of cracked product from the oil layer on the emerged disc
- Continued heating to carbonization temperatures on the emerged disc
- Coke removal before the disk is re-submerged Process Example With reference to FIG. 11 a process example for reducing the viscosity of a heavy oil feedstock is described.

Feedstock is unloaded into 3-day tank 20-T-01 equipped with a steam coil, where it is heated to 140° F. and subsequently pumped through pump 20-P-01 into heat recovery furnace 10-F-01, where it is further heated to 608° F. The resulting two-phase stream enters the 8-th tray of oil fractionation column 11-C-01. The liquid phase flows down column 11-C-01 over trays 9-12, where a light fraction is liberated. Tar bottoms flow by gravity from column 11-C-01 into a mixer 10-M-01 at a temperature of 644° F., where hydrated lime powder is added. The resulting suspension is pumped by centrifugal pump 10-P-01 to the RDTC 10-R-01 through vapor trap 10-V-02. The liquid level in 10-V-02 and, as a consequence, in 10-R-01 is controlled by pump 10-P-01.

The RDTC cracker 10-R-01 is operated within a temperature range of 779° F. (evaporation) and 1238° F. (end of coking). The HC vapors produced in the thermal cracking reaction flow to two parallel quenchers 10-V-01 A/B where they are cooled to 680° F. by oily water injection. Product vapors feed the bottom of oil wash columns 11-C-01, where they are contacted with fresh feedstock at trays 9-12 and with product oil at trays 1-8. A small withdraw of oil is taken from tray 7 to cover losses of the cooling oil circuit within the RDTC.

HC vapors from 11-C-01 at a temperature of 549° F. flow to the main condenser 11-A-01, where the resulting water/cracked oil/fuel gas streams are separated in three-phase separator 11-B-01. The gas phase feeds the FG header and any excess is burnt in bottom flare 11-X-01 equipped with flame arrestor 11-X-02.

The water phase flows by gravity to the oily water drum 11-B-02, also serving as a sump pump for the oily water header connected to quenchers 10-V-01 A/B and coke pit 10-S-01.

The cracked oil phase returns back to column 11-C-01 top as the reflux through pump 11-P-01 with net production being sent to an export facility.

Excess carbon and calcium sulphide resulting from the thermal cracking reaction is rejected from cracker 10-R-01 into the coke receiver 10-S-01, where it is cooled down to 212° F. in contact with oily water. Following cooling, it is removed by a bottom grate conveyor and transported in handle bins into a stacking yard, where contact with air causes intrinsic oxidation of calcium sulphide into water insoluble gypsum.

The RDTC cracker utilizes a cooling oil circuit, to keep bearing temperatures lower than 300° F. The return oil (typical temperature of 266° F. ) from the bearing cooling systems flows by gravity into cooling oil bin 10-B-02 after which it is pumped by 10-P-02 back to the cracker through the cooling oil cooler 10-A-01, where it is cooled down up to 140° F. If the product viscosity is out of range (for example due to an insufficient reflux), a portion of the cooling oil can be transferred to export facility using the pump 10-P-02.

Representative Data for Feedstock and Heavy and Light Cracked Products

Feedstock data:

At dry conditions:

| | |
|---|---|
| Specific gravity | 0.95 |
| API gravity | 17.6 |
| MWt | 365.4 lb/lb mole |
| Viscosity @ 122° F. | 105.6 cSt |
| Viscosity @ 212° F. | 9.9 cSt |
| Gasoline fraction NBP 160~355° F. | 4.9 Wt % |
| Diesel oil fraction NBP 355~680° F. | 33.7 Wt % |
| Vacuum oils fraction NBP 680~1025° F. | 25.7 Wt % |
| Tars fraction NBP 1025~1300° F. | 11.0 Wt % |
| Asphalts fraction NBP >1300° F. | 24.7 Wt % |
| Flash point | 149° F. |
| Water content | 0.005 lb/lb (dry) |

ASTM D86 760 mmHg, by volume:

| | |
|---|---|
| 1% | 294.3° F. |
| 5% | 375.1° F. |
| 10% | 604.0° F. |
| 30% | 661.3° F. |
| 50% | 764.4° F. |
| 70% | 1049.9° F. |
| 90% | 1470.9° F. |
| 95% | 1686.9° F. |
| 97% | 2084.5° F. |

Cracked oil data:

| At work conditions: | |
|---|---|
| Specific gravity | 0.87 |
| API gravity | 31.3 |
| MWt | 227.5 lb/lb mole |
| Viscosity @ 113° F. | 3.8 cSt |
| Viscosity @ 39° F. | 15.8 cSt |
| C1~C5 | 1.0 Wt % |
| Gasoline fraction NBP 160~355° F. | 9.3 Wt % |
| Diesel oil fraction NBP 355~680° F. | 69.5 Wt % |
| Vacuum oils fraction NBP 680~1025° F. | 20.3 Wt % |
| Tars fraction NBP 1025~1300° F. | <0.1 Wt % |
| Flash point | 41° F. |
| Water content | <500 Wt ppm |

ASTM D86 760 mmHg, by volume:

| | |
|---|---|
| 1% | <113° F. |
| 5% | 287.1° F. |
| 10% | 354.6° F. |
| 30% | 536.9° F. |
| 50% | 614.8° F. |
| 70% | 670.5° F. |
| 90% | 721.6° F. |
| 95% | 735.6° F. |
| 97% | 746.8° F. |

Heavy crack oil data:

At work conditions:

| | |
|---|---|
| Specific gravity | 0.92 |
| API gravity | 22.4 |
| MWt | 341.3 lb/lb mole |
| Viscosity @ 113° F. | 23.4 cSt |
| Viscosity @ 39° F. | 320.3 cSt |
| C1~C5 | <50 Wt ppm |
| Gasoline fraction NBP 160~355° F. | <0.1 Wt % |
| Diesel oil fraction NBP 355~680° F. | 20.2 Wt % |
| Vacuum oils fraction NBP 680~1025° F. | 79.6 Wt % |
| Tars fraction NBP 1025~1300° F. | <0.1 Wt % |
| Flash point | 293° F. |
| Water content | <500 Wt ppm |

ASTM D86 760 mmHg, by volume:

| | |
|---|---|
| 1% | 554.0° F. |
| 5% | 632.1° F. |
| 10% | 663.6° F. |
| 30% | 715.6° F. |
| 50% | 752.5° F. |
| 70% | 777.9° F. |
| 90% | 823.6° F. |
| 95% | 830.8° F. |
| 97% | 867.9° F. |

The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. A system for cracking hydrocarbons comprising:

a vessel for operatively receiving and containing a volume of liquid hydrocarbon feedstock;

a rotary drum assembly operably and rotatably contained within the vessel and in heating contact with the liquid hydrocarbon feedstock, the rotary drum assembly including a heating system for heating the internal surfaces of the rotary drum assembly during rotation of the rotary drum assembly within the liquid hydrocarbon feedstock wherein simultaneous rotation and heating of the rotary drum assembly causes cracking of the liquid hydrocarbon feedstock on the exterior surface of the rotary drum assembly and within the vessel;

a vapour product collection system operatively connected to the vessel for receiving cracked hydrocarbon vapours; and a coke removal system operatively contained within the vessel and on the exterior surface of the rotary drum assembly for removing coke from the exterior surface of the rotary drum assembly above the level of the liquid hydrocarbon feedstock and from the vessel.

2. A system as in claim 1 wherein the rotary drum assembly includes two frustoconical end sections and a central cylindrical section operatively mounted between front and back pipe sections.

3. A system as in claim 1 wherein the heating system is operatively contained with the front pipe section.

4. A system as in claim 3 wherein the drum assembly and vessel includes a bearing system and the bearing system includes a cooling system for cooling the bearings during operation.

5. A system as in claim 4 wherein the bearing cooling system includes a spiral oil path within each of the front and back pipe sections and the bearing system.

6. A system as in claim 4 wherein the bearing system on the back pipe section is external to the back pipe.

7. A system as in claim 1 wherein the heating system is a flame burner statically mounted within the rotating front pipe section.

8. A system as in claim 6 wherein the burner includes a secondary air injection system for injecting secondary air into an inside position of a conical flame.

9. A system as in claim 1 wherein the vapour product collection system includes a quenching system for quenching vapour product to prevent coking within the vapour product collection system.

10. A system as in claim 7 wherein the quenching system includes an oil/water spray system for contacting vapour product exiting the vessel.

11. A system as in claim 1 wherein the coke removal system includes a plurality of scrapers in operative contact with the exterior surface of the rotary drum assembly, the coke removal system including at least one coke pit for allowing coke to be removed from the vessel.

12. A system as in claim 9 wherein the scrapers are adjustable with respect to the rotating drum assembly.

13. A system for reducing hydrocarbon viscosity comprising:

a system for cracking hydrocarbons as described in claim 1 operably connected to a product distillation and collection system and a feed delivery system, the product distillation and collection system including a distillation column and reflux and the feed delivery system including a heating system from preheating feed before delivery to the system for cracking hydrocarbons.

14. A system as in claim 13 wherein the feed delivery system is operably connected to the distillation column for preheating and providing preliminary separation of light and heavy fractions of the feed.

15. A system as in claim 14 wherein the feed delivery system is operably connected to the exhaust side of the system for cracking hydrocarbons for preheating the feed.

* * * * *